United States Patent [19]

Dirriwachter et al.

[11] 3,934,557

[45] Jan. 27, 1976

[54] LOW FIRE LIGHT-OFF APPARATUS

[75] Inventors: John W. Dirriwachter; Robert J. Kelly, both of Richardson, Tex.

[73] Assignee: Forney Engineering Company, Carrollton, Tex.

[22] Filed: Oct. 1, 1974

[21] Appl. No.: 510,926

[52] U.S. Cl. ..... 122/448 B; 60/676; 236/26 E

[51] Int. Cl.[2] ..... F22B 37/42

[58] Field of Search ..... 236/26, 26 A, 26 E; 122/448 B; 60/676, 664

[56] References Cited

UNITED STATES PATENTS 2,366,968 1/1945 Kaufmann ..... 236/26 X

*Primary Examiner*—William E. Wayner

*Attorney, Agent, or Firm*—Marvin A. Naigur; John E. Wilson

[57] ABSTRACT

A control rod driven in correspondence with another regulating device may be independently extended to different positions corresponding to a selected condition while the other control arm remains at a fixed length and moves in correspondence with the driving means.

6 Claims, 4 Drawing Figures

FIG. 2
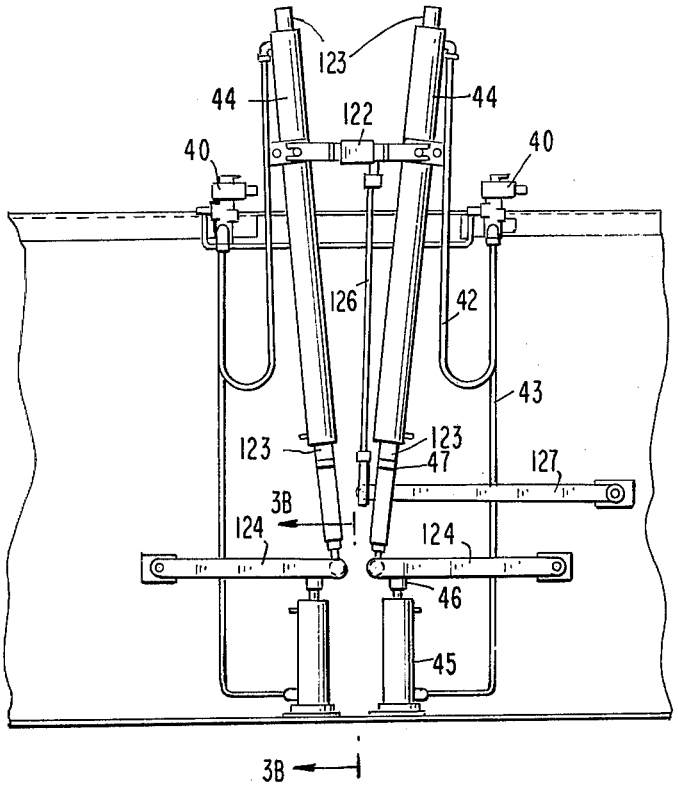
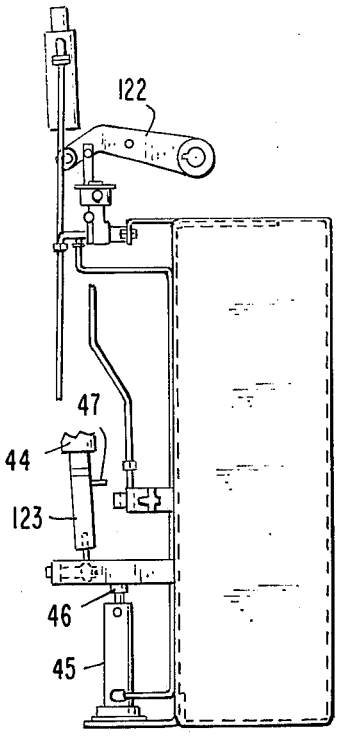
FIG. 3A
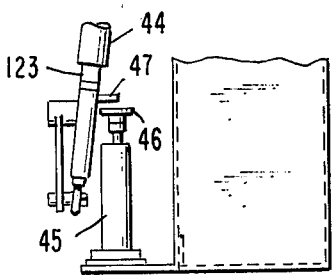
FIG. 3B

LOW FIRE LIGHT-OFF APPARATUS

BACKGROUND OF THE INVENTION

The invention herein has been developed in order to alleviate certain problems relative to the firing rates of multiple boiler marine power generating combustion control systems. Typically, a steam regulator responsive to electrical output characteristics of the boiler(s), operates fuel oil regulating valves controlling the pressure to burners for each of the boilers being controlled. The steam pressure regulator also provides a control for the air mixture which properly corresponds to the particular fuel oil pressure rating.

One of the problems associated with the control system of the prior art is that the steam pressure regulator utilized has fixed linkages which control the respective fuel regulating valves for each of the boilers in exact corresponce. Modification of the system to provide independent control of the fuel oil regulating valves is difficult to achieve in terms of both apparatus and economic requirements.

If independent control of the linkages for the respective fuel requlating valves is provided, one valve and corresponding boiler could be operated under normal firing conditions, whereas the other valve and boiler could be operated in light-off mode without first bringing the first operational boiler into correspondence with the boiler to be actuated.

Because many of the boilers in operation have over the years been modified by automation, a system for regulating the pressure to each of the boilers is desirable so that full advantage may be obtained from the automatic controls now available.

SUMMARY OF THE INVENTION

In accordance with an illustrative embodiment demonstrating features and advantages of the present invention, there is provided a control system for independently operating linkages for controlling output devices driven from a primary regulator. The linkages are extended in response to actuating means which provides motive force for shifting the relative positioning of the linkages between light-off and normal operating conditions. The linkages may thereafter be operated by the requlating means in either of their normal or extended positions so that control of one boiler is vertually independent of the other. For a better understanding of the present invention together with other and further objects thereof, reference is directed to the following description taken in connection with the accompanying drawings while its scope will be pointed out in the appended claims.

DESCRIPTION OF THE DRAWINGS

FIG. 2 is a view of the apparatus of the present invention with appropriate notation as to its relationship with FIG. 1.

FIG. 3a and 3b show a side view of the apparatus of FIG. 2 in respective retracted and extended positions.

DESCRIPTION OF THE PREFERRED EMBODIMENT

Figure 1:
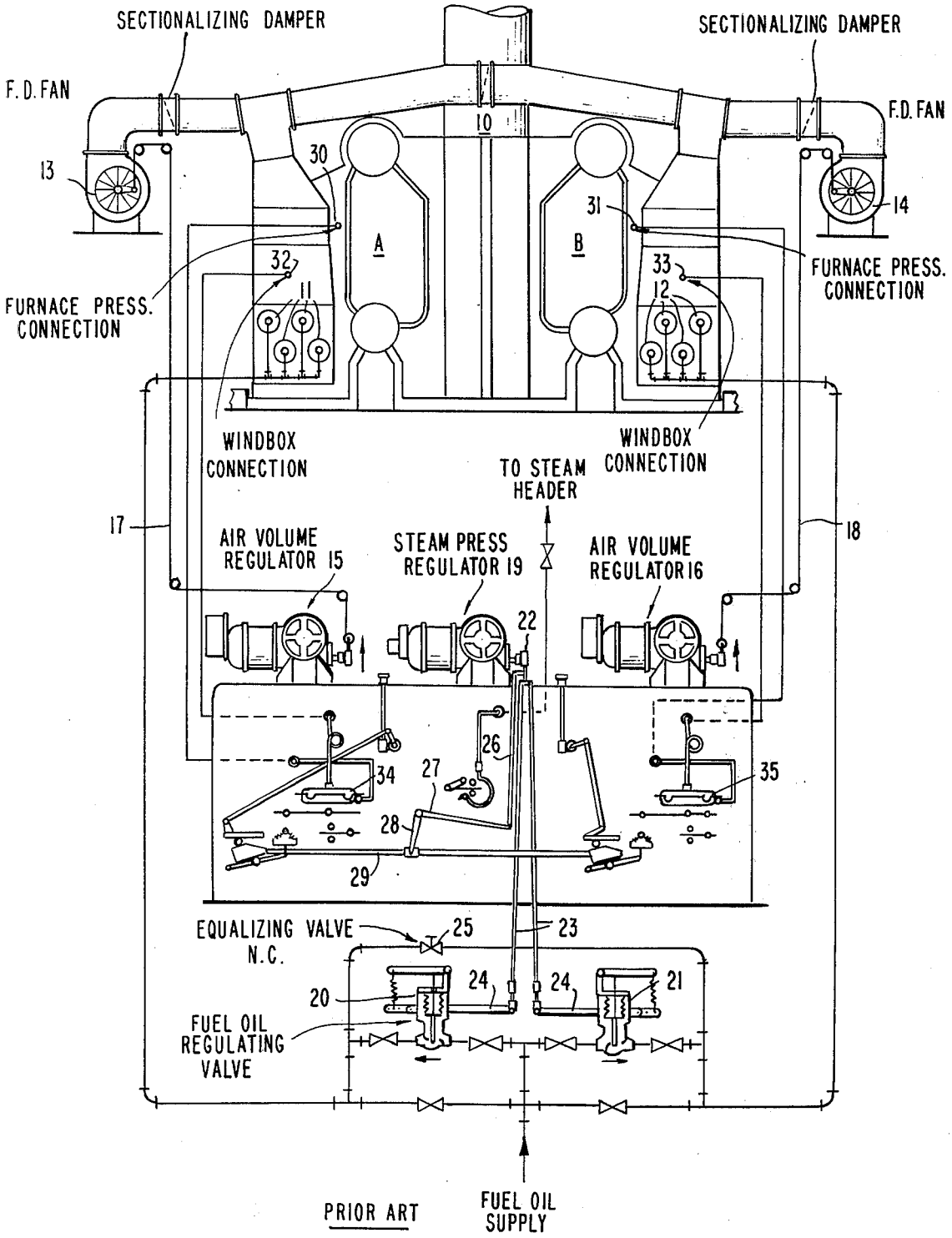
FIG. 1 is an illustration of the prior art utilizing the linkages normally associated therewith.

In FIG. 1 there is shown a marine power generating system 10 having at least two boilers A and B. Each of the boilers are fired by a plurality of burners 11 and 12, respectively. In addition, each of the boilers A and B have damper controls 13 and 14 driven by air volume regulators 15 and 16 over respective cables 17 and 18.

A steam pressure regulator 19 is responsive to the steam pressure output of the boilers for controlling the amount of fuel pressure to the boilers A and B over fuel oil regulating valves 20 and 21, respectively. The fuel oil regulating valves 20 and 21 are driven by power arm 22 over vertical linkage arm 23 and horizontal linkages 24.

The steam pressure regulator 19 also controls a feedback arm 26 which is coupled by a linkage 27 and 28 and 29 to vary the operation of the air volume regulators 15 and 16, respectively. The system is known as a system for regulating and testing furnace pressure at 30 and 31 and windbox flow at 32 and 33 for the respective boilers which control diaphragms 34 and 35, which in turn govern the air volume regulators 15 and 16, respectively.

In operation, steam pressure regulator 19, in response to the selected operational characteristics of the power generating system responds to actuate power arm 22 for driving linkages 23 upwardly or downwardly for controlling the fuel regulating valves 20 and 21 which in turn control the amount of fuel pressure to the boilers. It is clear from the illustration of the prior art, that the linkages 23 must move in correspondence for regulating the actuation of the fuel oil regulating valves 20 and 21 at the same rate. The apparatus of the present invention, on the other hand, is designed so that fuel oil regulating valves 20 and 21 may be actuated at different rates such that if boiler A is operating at a certain output, boiler B may be on stand-by for light-off in the event that that boiler is called into service.

Referring to FIG. 2, a one hundred series of reference numerals will be utilized to correlate corresponding elements of Fig. 1. Power arm 122 and linkages 123 operate in a similar manner to the power arm 22 and linkages 23 of FIG. 1. Linkage arms 124 are similar in function to those corresponding arms 24 in FIG. 1 as well as feedback arm 126 and 127 etc.

In the present invention relay controls 40 are separately actuated from a normally closed position to an open position upon a control signal from independent control means not shown. In the normally closed position, relays 40 have no effect on the system which operates as previously described; however, if it is desired to operate one boiler under full load condition and the other in light-off mode, one of the relays 40 will be actuated to an open position so as to change the effective operating length of its respective linkage 123.

An example of an operation of the present invention is discussed below, wherein boiler A is operating under full load with its control arm 123 (left) positioned so as to regulate the fuel oil valve 124 (left) associated therewith at a selected pressure; however, boiler B if in a light-off condition requires a substantially lower pressure for the corresponding burners 12. Under these conditions, relay 40 (right) is actuated so as to provide pressure through pneumatic lines 42 and 43 to actuate pneumatic cylinders 123 (right linkage) and 45, respectively. Fluid pressure from lines 42 and 43 causes the respective pneumatic cylinders 123 and 45 to extend, i.e. control arm 123 associated with actuating line 42 piston 44 extends downwardly whereas the piston 45 and head assembly 46 extends upwardly. Stop member is 47 associated with piston 44 engages with head assembly 46. In FIGS. 3*a* and 3*b*, this relationship can be shown such that in FIG. 3*a* the pneumatic cylinder 44 is in the normal position with relay 40 closed and stop member 47 displaced away from the head assembly 46. Whereas in FIG. 3*b* the relay 40 having been actuated to the open position causes the respective cylinder members 44 and 45 to extend downwardly and upwardly in accordance with their degrees of freedom. Thereafter, the steam pressure regulator may actuate both left and right arms 123 in correspondence in accordance with the requirements of the operational control characteristic but the linkage 123 (right) remains in the downwardmost position shown in FIG. 3*b* so that the boiler B may be prepared for light-off whereas the boiler A may be controlled in accordance with the requirements for fuel pressure under normal conditions. It should be noted power arm 122 drives the linkage 123 through trunion apparatus 48.

Under the system of the present invention the versatility of a multiple boiler power generating system may be fully achieved in view of the advances made in the area of automatic boiler control systems with a reliable and relatively easily adapted modification of existing systems. While there has been described what at present is considered to be the preferred embodiment of the present invention, it will be obvious to those skilled in the art that various changes and modifications may be made therein without departing from the invention, and it is intended in the following claims to cover all such changes and modifications as fall within the true scope and spirit of the invention.

What is claimed is:

1. Apparatus for controlling a plurality of fuel fired vapor generators for powering a marine propulsion system wherein each vapor generator may be operated in a low fire lightoff mode for ignition and a power mode for driving the propulsion system comprising:

control means operatively coupled to each vapor generator for controlling operation thereof in said respective power and lightoff modes, a regulator responsively coupled to said control means for delivering drive control outputs, a common drive coupled to the regulator and responsive to the drive control outputs, fuel regulator means for each vapor generator responsively coupled to said common drive for delivering fuel to each of said vapor generators in accordance with the drive control outputs, a variable displacement linkage arm coupling said common drive with each of said fuel regulator means, each linkage arm capable of being actuated to respective first and second retracted and extended lengths, and selection means operatively coupled to each linkage arm for selectively actuating each linkage arm to said respective first and second retracted and extended lengths, said selection means responsively coupled to said control means to actuate said linkage arm to said respective first and second retracted and extended lengths in accordance with the respective power and lightoff mode of each of the power generators, whereby each vapor generator may be operated in either mode by the common drive without affecting the operation of the other.

2. The apparatus as described in claim 1 wherein each variable linkage arm includes:

main pneumatic cylinder means having one end coupled to the common drive and another end telescopically connected to and associated with one of said fuel regulator means, said main pneumatic cylinder means responsive when actuated by the selection means to assume said respective first and second retracted and extended lengths.

3. The apparatus as described in claim 2 wherein said selection means includes:

a pneumatic relay valve coupled to an associated one of each of the main pneumatic cylinder means, each responsively coupled to the control means to be operative when actuated thereby to deliver a working fluid to its associated main pneumatic cylinder means for actuating same to said respective first and second retracted and extended lengths.

4. The apparatus as described in claim 3 further comprising:

auxiliary pneumatic cylinder means for engaging an associated one of each of said linkage arms having a fixed end and a telescopically controlled movable free end, said auxiliary pneumatic cylinder means coupled to the relay valve associated with the main pneumatic cylinder means likewise responsive to the delivery of the working fluid upon actuation of said relay valve, said auxiliary pneumatic cylinder means telescopically extending and engaging with the telescopically movable end of the associated main pneumatic cylinder means in its extended position for maintaining a limit thereto, each of said auxiliary pneumatic cylinder means being controlled in correspondence with the main pneumatic cylinder means.

5. The apparatus as described in claim 1 further including: a trunion assembly for each linkage arm engaging with said common drive output, and the associated linkage arm.

6. The apparatus of claim 3 wherein said main pneumatic cylinder means and said auxiliary pneumatic cylinder means are spring-biased to the retracted length and wherein the actuation of said corresponding relay valve to an open condition delivers the working fluid under pressure and causes telescopic extension of each of said cylinders in opposition to said spring bias and wherein actuation of the relay to a closed condition releases said pressure against the bias of the spring so as to telescopically retract the pneumatic means.

* * * * *

UNITED STATES PATENT AND TRADEMARK OFFICE

CERTIFICATE OF CORRECTION

PATENT NO. : 3,934,557

DATED : January 27, 1976

INVENTOR(S) : John W. Dirriwachter and Robert J. Kelly

It is certified that error appears in the above-identified patent and that said Letters Patent are hereby corrected as shown below:

In the Specification:

Column 1, line 18, delete "cor-responce" and insert therefor --correspondence--.

Column 1, line 46, delete "vertually" and insert therefor --virtually--.

Column 2, line 9, delete "linkage arm" and insert therefor --linkages--.

Column 2, line 39, delete "linkage arms" and insert --linkages--.

Column 2, line 40, delete "arms" and insert --linkages--.

Column 2, line 54, delete "control arm" and insert --linkage--.

Column 2, line 61, delete "pneumatic cylinders" and insert therefor --right linkage--.

Column 2, line 61, delete "(right linkage)", and insert after "and" --pneumatic cylinder--, and insert after "45" --having a piston--.

Column 2, lines 62, 63, 64, 65, and 66, delete sentence "Fluid pressure ...upwardly." and insert therefor --Fluid pressure from lines 42 and 43 causes the respective linkage 123 and piston of cylinder 45 to move, i.e. linkage 123 associated with pneumatic line 42 and pneumatic cylinder 44 moves downwardly whereas the piston of cylinder 45 and bead assembly 46 move upwardly.--.

Column 2, line 67, delete "is".

Column 3, line 6, delete "cylinder members" and insert therefor --pneumatic cylinder--, and after "and" insert --piston of cylinder--.

Column 3, line 9, delete "arms" and insert therefor --linkages--.

UNITED STATES PATENT AND TRADEMARK OFFICE

CERTIFICATE OF CORRECTION

PATENT NO. : 3,934,557

DATED : January 27, 1976

INVENTOR(S) : John W. Dirriwachter and Robert J. Kelly

It is certified that error appears in the above-identified patent and that said Letters Patent are hereby corrected as shown below:

In the Claims:

Column 3, lines 47, 49, 52 and 56, delete "arm".

Column 4, line 7, delete "arm".

Column 4, lines 17 and 18, delete "one of each of the".

Column 4, line 17, after "means," insert --said cylinder means--.

Column 4, line 18, delete "each".

Column 4, lines 44 and 46, delete "arm".

Signed and Sealed this

Twenty-second Day of February 1977

[SEAL]

*Attest:*

RUTH C. MASON
*Attesting Officer*

C. MARSHALL DANN
*Commissioner of Patents and Trademarks*